US006382153B1

(12) United States Patent
Rohe et al.

(10) Patent No.: US 6,382,153 B1
(45) Date of Patent: May 7, 2002

(54) PARTIAL INTERNAL GUIDE FOR CURVED HELICAL COMPRESSION SPRING

(75) Inventors: Jeffrey D. Rohe, Caledonia; Ronald J. Pierik; Thomas H. Fischer, both of Rochester, all of NY (US); William R. Haslett, Hanover, NH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/832,582

(22) Filed: Apr. 11, 2001

(51) Int. Cl.[7] ..... F01L 13/00; F01L 3/10

(52) U.S. Cl. ..... 123/90.16; 123/90.17; 123/90.65; 123/90.67

(58) Field of Search ..... 123/90.15, 90.16, 123/90.17, 90.22, 90.31, 90.6, 90.65, 90.67

(56) References Cited

U.S. PATENT DOCUMENTS 5,623,897 A * 4/1997 Hampton et al. ..... 123/90.16
5,937,809 A * 8/1999 Pierik et al. ..... 123/90.16
5,996,540 A * 12/1999 Hara ..... 123/90.16
6,019,076 A * 2/2000 Pierik et al. ..... 123/90.16
6,295,958 B2 * 10/2001 Pierik ..... 123/90.16

* cited by examiner

*Primary Examiner*—Weilun Lo
(74) *Attorney, Agent, or Firm*—John VanOphem

(57) ABSTRACT

A variable valve actuating comprising a spring guide for use with a curved spring includes an elongate, curved guide member having a centerline. The centerline has a centerline curvature that is substantially equal to the radius of curvature of the curved spring. The guide member has a first side having a side curvature. The side curvature is substantially equal to a curvature of the curved inside surfaces of the coils of the curved spring. The guide member is configured for being disposed within the curved spring such that the coils thereof substantially surround a periphery of the guide member.

16 Claims, 3 Drawing Sheets

PARTIAL INTERNAL GUIDE FOR CURVED HELICAL COMPRESSION SPRING

FIELD OF THE INVENTION

The present invention relates generally to variable valve actuating mechanisms and, more particularly, to a spring guide for use with a variable valve actuating mechanism.

DESCRIPTION OF THE RELATED ART

Variable valve actuating mechanisms enable the variation of the timing, lift and duration (i.e., the valve lift profile) of associated valves, such as, for example, the valves of an internal combustion engine. Two examples of variable valve actuating mechanisms are detailed in commonly-assigned U.S. Pat. No. 5,937,809 and 6,019,076, the disclosures of which are incorporated herein by reference.

As related to internal combustion engines, conventional variable valve mechanisms are associated with a cam or input shaft of the engine. More particularly, a conventional variable valve mechanism typically includes a roller which engages an input cam of the input shaft or the engine camshaft. The roller is linked to an output cam, such as, for example, by one or more link or rocker arms. Rotation of the input cam displaces the roller and thereby creates oscillatory movement of the linking components. The oscillatory movement of the linking components, in turn, directly or indirectly oscillate the output cam, which, in turn, actuates one or more associated valves of the engine.

Many conventional variable valve actuating mechanisms incorporate a biasing means, such as one or more return springs, that biases the output cam toward its starting position. The return spring is compressed as the output cam is oscillated counter-clockwise from its starting position in order to actuate or open the associated valve, and expanded or decompressed during the closing of the associated valve. The expansion or decompression force of the spring returns the output cam to its starting position. Typically, the return springs are flat or non-curved helical springs, i.e., the centerline or central axis of the spring is substantially straight. Flat springs have a natural frequency or mode of vibration, often referred to as spring surge, that is generally directed along the central axis of the flat spring. The maximum operational frequency of the mechanism is limited to approximately eight to ten times less than the natural frequency of the flat or non-curved spring.

Curved springs are generally semicircular in shape, i.e., have a curved central axis relative to which the spring coils are substantially concentric. The use of a curved spring in a variable valve actuating mechanism has the advantage of saving space and/or eliminating a link or return bar. However, curved springs have an inherent additional vibrational mode or natural frequency which is not found in any significant magnitude in a flat or non-curved spring. This additional vibrational mode or natural frequency of a curved spring occurs in the middle-most coils of the curved spring in a direction that is generally perpendicular to the plane of the curved spring central axis, and is substantially lower than the natural frequency of the spring surge in a flat or non-curved spring. Due to this additional, lower natural frequency of a curved spring, the maximum operational frequency of a variable valve actuating mechanism having a curved return spring is only a fraction, i.e., approximately one-half to three-fourths, of the maximum operational frequency of the same mechanism using a flat or non-curved spring.

In an effort to compensate for the lowered maximum operational frequency of a variable valve actuating mechanism having a curved spring, external spring guides can be used. Such external guides generally surround the periphery of the spring, and thus consume additional space and/or volume. Furthermore, such external spring guides have a radius that is larger than the spring which they are guiding, and are therefore subject to relatively large frictional forces and relatively large torque hysteresis.

Therefore, what is needed in the art is a device that permits the use of a curved spring at greater maximum frequencies of compression and expansion.

Furthermore, what is needed in the art is a device which reduces the amplitude of the additional mode of vibration or natural frequency of a curved spring.

Even further, what is needed in the art is a device which increases the limited maximum operational frequency of a variable valve actuating mechanism having a curved spring.

Still further, what is needed in the art is a spring guide device that occupies less space and/or volume than a conventional external spring guide.

Moreover, what is needed in the art is a spring guide device that reduces frictional forces and torque hysteresis relative to an external spring guide device.

SUMMARY OF THE INVENTION

The present invention provides an internal spring guide for use with a curved spring.

The invention comprises, in one form thereof, an elongate, curved guide member having a centerline. The centerline has a centerline curvature that is substantially equal to a radius of curvature of the curved spring. The guide member includes a first side having a side curvature. The side curvature is substantially equal to a curvature of the curved inside surfaces of the coils of the curved spring. The guide member is configured for being disposed within the curved spring such that the coils thereof substantially surround a periphery of the guide member.

An advantage of the present invention is that it permits the use of a curved spring at greater maximum frequencies of compression and expansion.

Another advantage of the present invention is that it increases the limited operational frequency of a variable valve actuating mechanism having a curved spring to approximately the same maximum operational frequency of a variable valve actuating mechanism incorporating a flat spring.

Yet another advantage of the present invention is that it occupies less space and/or volume than is occupied by a conventional external spring guide.

A still further advantage of the present invention is that it reduces frictional forces and torque hysteresis relative to an external spring guide device.

Sill further advantages of the present invention will be obvious to one skilled in the art and/or appear hereinafter.

BRIEF DESCRIPTION OF THE DRAWINGS

The above-mentioned and other features and advantages of this invention, and the manner of attaining them, will become appreciated and be more readily understood by reference to the following detailed description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE DRAWINGS

Figure 1:
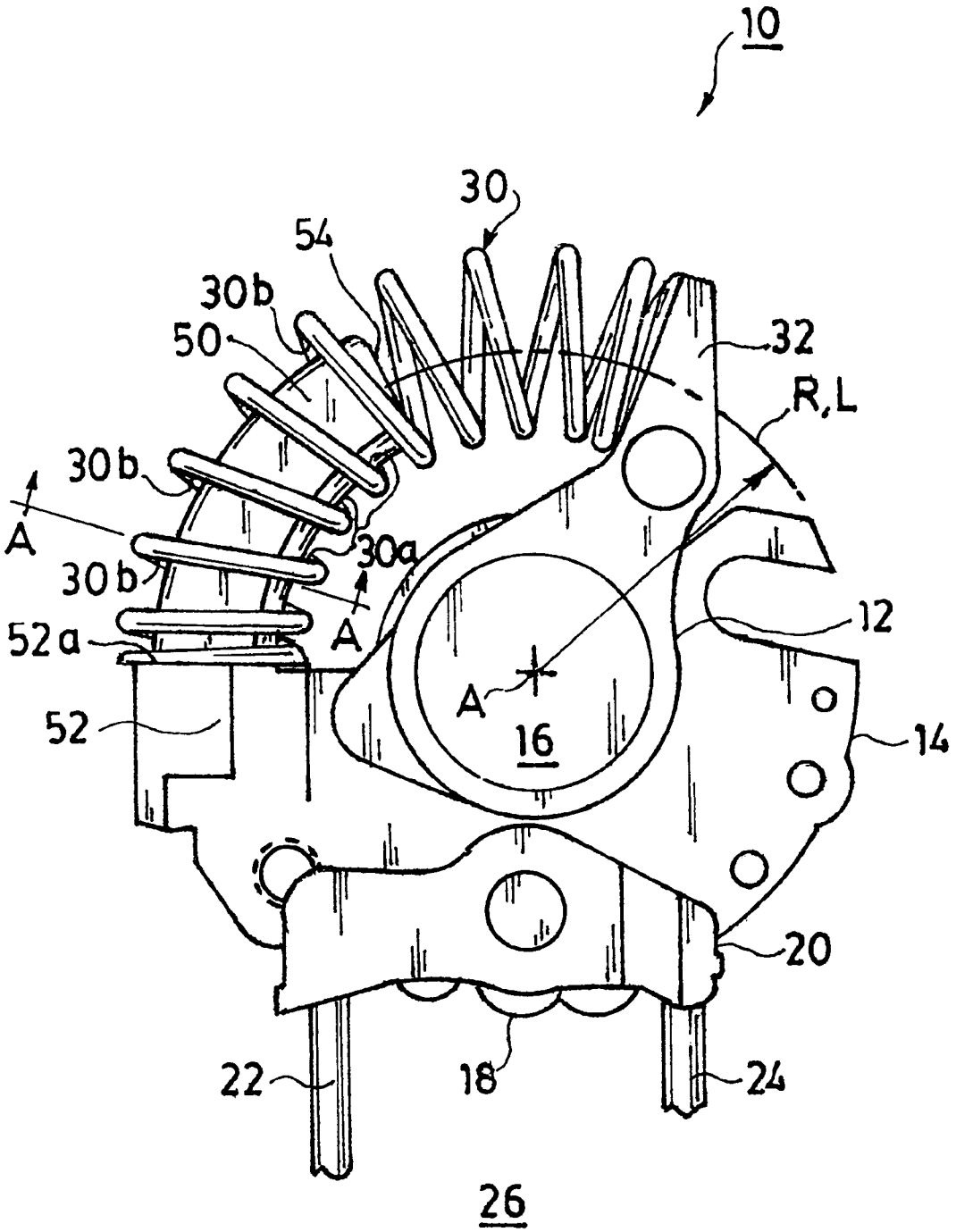
FIG. 1 is a side view of a variable valve actuating mechanism having one embodiment of an internal spring guide of the present invention operably installed thereon.

Referring now to the drawings, and particularly to FIG. 1, there is shown a variable valve actuating mechanism having installed thereon one embodiment of an internal spring guide of the present invention.

Generally, variable valve actuating mechanism 10 includes output cam 12 and frame member 14. Output cam 12 is pivotally mounted upon rotary input shaft 16 and engages roller 18 of roller finger follower (RFF) 20. As a result of the rotation of an input cam (not shown) affixed to or integral with rotary input shaft 16, output cam 12 is pivoted in a counter-clockwise direction relative to central axis A of rotary input shaft 16. As output cam 12 pivots in this counter-clockwise direction, the lift profile (not referenced) of output cam 12 engages roller 18 and thereby pivots RFF 20 about lash adjuster 22. The pivoting of RFF 20 about lash adjuster 22, in turn, activates a corresponding valve 24 of engine 26. The valve lift profile is varied by changing the angular position of frame member 14 relative to central axis A, which, in turn, changes the angular position of output cam 12 relative to central axis A.

Return spring 30 is a helical compression spring, having a radius of curvature R. At a first end (not referenced) return spring 30 engages or is interconnected with frame member 14, and at the other end return spring 30 engages arm 32 of output cam 12. Thus, return spring 30 is compressed along radius of curvature R thereof as output cam 12 is pivoted in the counter-clockwise direction relative to central axis A by the input cam of input shaft 16. As the input cam of input shaft 16 rotates from the portion of its lift profile which causes the counterclockwise rotation of output cam 12 and towards the base circle portion return spring 30 expands or decompresses and thereby biases output cam 12 toward its starting position. More particularly, arm 32 rotates as one body with output cam 12, and compresses return spring 30 during counterclockwise rotation of output cam 12. Similarly, return spring 30 acts on arm 32, and thus output cam 12, during decompression or expansion.

Return spring 30 includes a plurality of coils (not referenced) which are substantially concentric relative to radius of curvature R. These coils have inside surfaces 30*a* and 30*b*. Inside surfaces 30*a* are disposed on the inside of the coils and disposed nearest input shaft 16, i.e., between radius of curvature R and input shaft 16. Inside surfaces 30*b* are also on the inside of the coils, but are disposed furthest from input shaft 16, i.e., outside of radius of curvature R relative to input shaft 16.

In the static condition, radius of curvature R is substantially fixed and the coils (not referenced) of return spring 30 are substantially concentric relative to radius of curvature R. However, as return spring 30 is compressed, the coils thereof, and particularly the coils near its midpoint (not referenced), are displaced radially outward and thereby force the radius of curvature R to change along the length of the spring. The change in the radius of curvature R, and thus the distortion in the shape of return spring 30, is proportional to the extent to which return spring 30 is compressed. Associated with the change in the radius of curvature R are a loss in torque delivered by, and an increase in coil stresses within, return spring 30.

Internal spring guide 50 is an elongate member that is generally claw-shaped or semi-circular in shape, having a curved centerline L. The curvature of centerline L is substantially equal to the radius of curvature R of return spring 30. Internal spring guide 50 is disposed within return spring 30 such that centerline L is substantially coaxial with radius of curvature R of return spring 30. Stated alternatively, a portion of return spring 30 surrounds the periphery of internal spring guide 50. Internal spring guide 50 includes a first end 52, second end 54, opposing sides 56, 58 (FIG. 2).

First end 52 is affixed, such as, for example, by press fit, swaged, or by screwing or bolting, to frame member 14. Further, first end 52 defines a spring seat 52*a*, which acts to support and transfer the spring force of return spring 50 to frame member 14. Second end 54 of internal spring guide 50 is disposed at approximately the midpoint, and preferably slightly beyond the midpoint, of the arc length between frame member 14 and arm 32 of output cam 12. Second end 54 includes radius 54*a* disposed adjacent side 56 and radius 54*b* disposed adjacent side 58, which provide a smooth transition between side 56 and 58, respectively, and second end 54.

Figure 2:
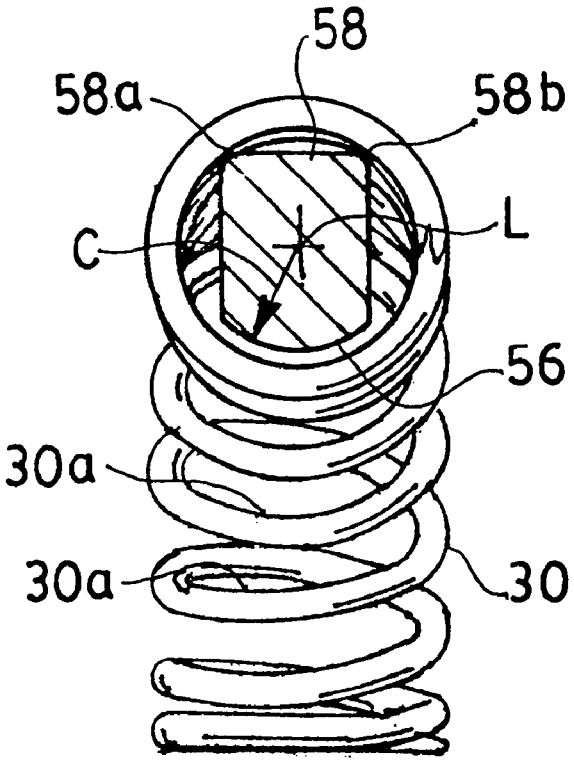
FIG. 2 is a cross-sectional view taken at line A—A of the internal spring guide of FIG. 1.
Figure 3:
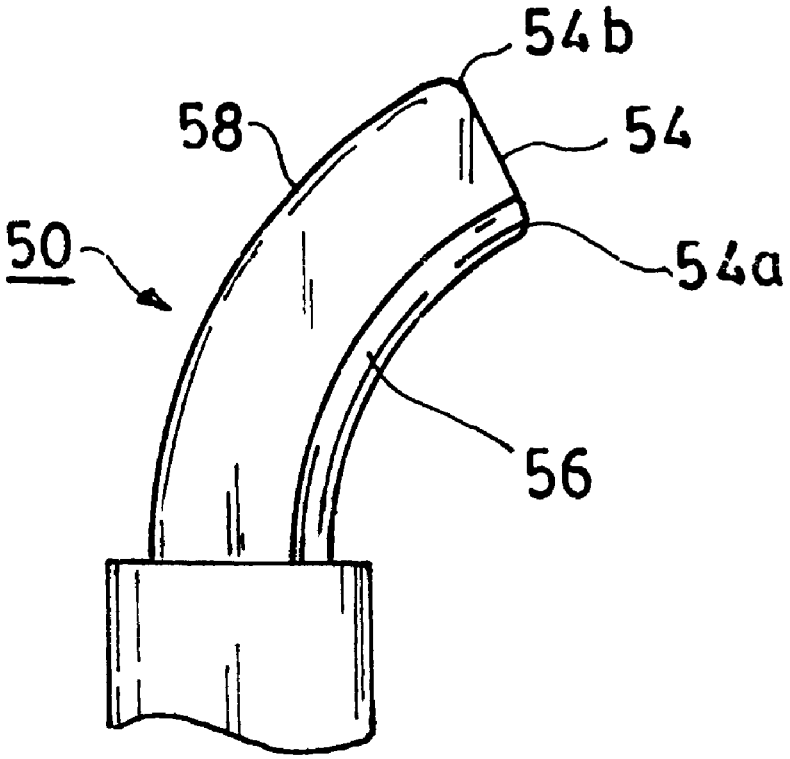
FIG. 3 is a side view of the internal spring guide of FIG. 1.

Referring now specifically to FIG. 2, side 56 is disposed most proximate to or facing input shaft 16. Accordingly, side 58 is disposed most distant or facing away from input shaft 16. Side 56 is generally oval or semicircular in shape, and has a curvature C that is substantially the same as or closely matched to the inside curvature of the coils of return spring 30. Side 56 engages or is disposed in close proximity to inside surfaces 30*a* of the coils of return spring 30. As stated above, second end 54 of internal spring guide 50 is disposed at or preferably slightly beyond the midpoint of the arc length between frame member 14 and arm 32 of output cam 12. Thus, at least half, and preferably over half, of inside surfaces 30*a* are disposed in close proximity to or in sliding engagement with curved side 56.

Side 58 is generally flat or slightly convex in shape, and includes rounded corners 58*a*, 58*b*. Rounded corners 58*a*, 58*b* engage or are disposed in close proximity to inside surfaces 30*b* of return spring 30. At least half, and preferably over half, of inside surfaces 30*b* are disposed in close proximity to or in sliding engagement with rounded corners 58*a*, 58*b* of side 58.

In use, return spring 30 is alternately compressed and expanded due to oscillatory movement of output cam 12. More particularly, as output cam 12 is pivoted counterclockwise, return spring 30 is compressed. As the input cam of input shaft 16 rotates from the lift portion of its profile back toward the zero lift or base circle portion, the force of return spring 30 pivots output cam 12 clockwise and return spring 30 expands to thereby return output cam 12 to its starting angular position relative to input shaft 16.

As stated above, the compression of curved return spring 30 results in an additional vibrational mode or natural frequency relative to a flat or non-curved spring. Internal spring guide 50 reduces the amplitude of this additional mode of vibration to thereby increase the maximum operational frequency of curved return spring 30, and thus increase the maximum operational frequency at which variable valve actuating mechanism 10 can be used.

The additional vibrational mode occurs in the middlemost coils of return spring 30 in a direction that is generally normal to the plane formed by radius of curvature R of return spring 30 and curved centerline L of internal spring guide 50. Thus, as return spring 30 is compressed, the middle-most coils thereof tend to be displaced in a direction that is generally normal to the plane formed by radius of curvature R and curved centerline L, i.e., in a direction generally parallel to central axis A of input shaft 16. Side 56 of internal spring guide 50 is in sliding engagement with or in close proximity to inside surfaces 30*a* of the middle-most coils of return spring 30, and thereby substantially limits displacement of those coils in a direction that is generally perpendicular to radius of curvature R and generally away from input shaft 16. Similarly, rounded corners 58*a*, 58*b* of face 58 are disposed in close proximity to or in sliding engagement with inside surfaces 30*b* of the middle-most coils of return spring 50 to limit displacement of those coils in a direction that is generally perpendicular to radius of curvature R and generally toward input shaft 16.

Thus, faces 56 and 58 of internal spring guide 50 substantially limit the displacement of the middle-most coils of return spring 30 in a direction generally toward and away from input shaft 16. Corners 58*a*, 58*b* limit motion of the coils in a direction that is generally perpendicular to the plane formed by radius of curvature R and curved centerline L, i.e., in a direction generally parallel to central axis A of input shaft 16. Thus, radius of curvature R is substantially prevented from changing as return spring 30 is compressed and/or expanded. By keeping the coils from displacing in a direction parallel to central axis A of input shaft 16, the amplitude of the additional vibrational mode of curved return spring 30 is substantially reduced. The reduction of the amplitude of the additional vibrational mode increases the maximum operational frequency limit of return spring 30, and thus increases the maximum operational frequency limit of variable valve actuating mechanism 10.

It should be particularly noted that, as return spring 30 is compressed, certain of the coils thereof are displaced in close proximity or in sliding engagement over second end 54. Radius 54*a* and 54*b* of second end 54 provide a transition surface that substantially reduces the likelihood of a coil of return spring 30 catching or binding on second end 54 as return spring 30 undergoes compression.

In the embodiment shown, internal spring guide 50 is configured for use with variable valve actuating mechanism 10. However, it is to be understood that the internal spring guide of the present invention can be alternately configured, such as, for example, for use with various and different variable valve actuating mechanisms. Further, it is to be understood that the internal spring guide of the present invention can be alternately configured, such as, for example, for use with other types of mechanisms which may advantageously utilize a curved biasing or return spring.

In the embodiment shown, first end 52 of internal spring guide 50 is affixed, such as, for example, by press fit, swaged, or by screwing or bolting, to frame member 14. However, it is to be understood that the first end of the internal spring guide of the present invention may be alternately configured, such as, for example, with a threaded bore which threadingly connects to a correspondingly threaded projection of a frame or other member. Furthermore, it is to be understood that in such an embodiment, the first end of the internal spring guide of the present invention can be, for example, hexagonal in shape to facilitate tightening of the guide onto the threaded projection. Moreover, it is to be understood that the internal spring guide can be integrally formed and/or monolithic with the frame member.

In the embodiment shown, second end 54 includes radius 54*a* disposed adjacent side 56 and radius 54*b* disposed adjacent side 58. However, it is to be understood that second end 54 can be alternately configured, such as, for example, with chamfered or angled surfaces adjacent sides 56, 58, which would similarly provide a non-binding transition surface as described above.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A variable valve actuating mechanism, comprising:

a helical curved return spring having a first spring end and a second spring end, said first spring end associated with a frame member of said variable valve mechanism, said second spring end associated with an output cam of said variable valve actuating mechanism, said curved return spring having a radius of curvature and a plurality of coils, each of said plurality of coils being substantially concentric with said radius of curvature and having curved inside surfaces; and an elongate, curved guide member having a first guide end and a centerline, said first guide end affixed to said frame member, said centerline having a centerline curvature, said centerline curvature being substantially equal to said radius of curvature of said curved return spring, said guide member disposed within said curved return spring such that said plurality of coils substantially surround a periphery of said guide member.

2. The variable valve mechanism of claim 1, wherein said centerline of said guide member is substantially coaxial with said radius of curvature of said curved return spring.

3. The spring guide of claim 1, wherein said curved return spring has a first spring end, a second spring end and a midpoint disposed approximately half way between said first and second spring ends, said guide member having a second guide end disposed proximate said midpoint.

4. The spring guide of claim 3, wherein said second guide end is disposed intermediate said midpoint and said second spring end.

5. The spring guide of claim 3, wherein said second end of said guide member is disposed intermediate said midpoint and said first spring end.

6. The spring guide of claim 1, wherein said guide member further comprises a first side, said first side having a side curvature, said side curvature being substantially equal to a curvature of said curved inside surfaces of said plurality of coils.

7. The spring guide of claim 6, wherein said first side of said guide member is disposed in close proximity to corresponding said inside surfaces of approximately half of said plurality of coils.

8. The spring guide of claim 6, wherein said first side of said guide member is disposed in close proximity to corresponding said inside surfaces of at least half of said plurality of coils.

9. The spring guide of claim 6, wherein said first side of said guide member is in sliding engagement with corresponding said inside surfaces of approximately half of said plurality of coils.

10. The spring guide of claim 6, wherein said first side of said guide member is in sliding engagement with corresponding said inside surfaces of at least half of said plurality of coils.

11. The spring guide of claim 1, wherein said guide member further includes a second side, said second side having rounded corners.

12. The spring guide of claim 11, wherein said rounded corners are disposed in close proximity to corresponding said inside surfaces of approximately half of said plurality of coils.

13. The spring guide of claim 11, wherein said rounded corners are in sliding engagement with corresponding said inside surfaces of approximately half of said plurality of coils.

14. The spring guide of claim 11, wherein said rounded corners are disposed in close proximity to corresponding said inside surfaces of at least half of said plurality of coils.

15. The spring guide of claim 11, wherein said rounded corners are in sliding engagement with corresponding said inside surfaces of at least half of said plurality of coils.

16. An internal combustion engine, comprising:

a variable valve actuating mechanism including a helical curved return spring, said return spring having a first spring end and a second spring end, said first spring end associated with a frame member of said variable valve actuating mechanism, said second spring end associated with an output cam of said variable valve actuating mechanism, said curved return spring having a radius of curvature and a plurality of coils, each of said plurality of coils being substantially concentric with said radius of curvature and having curved inside surfaces; and an elongate, curved guide member having a first guide end and a centerline, said first guide end affixed to said frame member, said centerline having a centerline curvature, said centerline curvature being substantially equal to said radius of curvature of said curved return spring, said guide member disposed within said curved return spring such that said plurality of coils substantially surround a periphery of said guide member.

* * * * *